US008760378B2

(12) United States Patent
Lee

(10) Patent No.: US 8,760,378 B2
(45) Date of Patent: Jun. 24, 2014

(54) LIQUID CRYSTAL DISPLAY FOR REDUCING DISTORTION OF COMMON VOLTAGE

(75) Inventor: Juyoung Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 81 days.

(21) Appl. No.: 12/948,339

(22) Filed: Nov. 17, 2010

(65) Prior Publication Data

US 2011/0134102 A1 Jun. 9, 2011

(30) Foreign Application Priority Data

Dec. 3, 2009 (KR) ..... 10-2009-0119387

(51) Int. Cl.
*G09G 3/36* (2006.01)

(52) U.S. Cl.
USPC ..... 345/87; 345/211

(58) Field of Classification Search
USPC ..... 345/87, 211
See application file for complete search history.

(56) References Cited

U.S. PATENT DOCUMENTS

| | | | | |
|---|---|---|---|---|
| 7,561,136 | B2 * | 7/2009 | Hong et al. | 345/98 |
| 2005/0156840 | A1 * | 7/2005 | Kim et al. | 345/87 |
| 2005/0212735 | A1 * | 9/2005 | Lin | 345/87 |
| 2006/0290646 | A1 * | 12/2006 | Kang | 345/100 |

* cited by examiner

*Primary Examiner* — Kwang-Su Yang
(74) *Attorney, Agent, or Firm* — Morgan, Lewis & Bockius LLP

(57) ABSTRACT

A liquid crystal display includes a liquid crystal display panel on which gate lines and data lines cross one another and liquid crystal cells are respectively arranged at crossings of the gate lines and the data lines in a matrix form, a panel common line connected to common electrodes of the liquid crystal cells, a power supply circuit generating a common voltage to be applied to the common electrodes, data circuit groups each including a data driver integrated circuit (IC) for driving the data lines, and gate circuit groups each including a gate driver IC for driving the gate lines. The gate circuit groups is connected to one of the plurality of data circuit groups through a first line-on-glass (LOG) type signal line group.

6 Claims, 5 Drawing Sheets

LIQUID CRYSTAL DISPLAY FOR REDUCING DISTORTION OF COMMON VOLTAGE

This application claims the benefit of Korean Patent Application No. 10-2009-0119387 filed on Dec. 3, 2009, which is incorporated herein by reference for all purposes as if fully set forth herein.

BACKGROUND OF THE INVENTION

1. Field of the Invention

Embodiments of the invention relate to a liquid crystal display capable of reducing a distortion of a common voltage.

2. Discussion of the Related Art

An active matrix type liquid crystal display displays a motion picture using a thin film transistor (TFT) as a switching element. The active matrix type liquid crystal display has been implemented in televisions as well as display devices in portable devices such as office equipments and computers, because of the thin profile of the active matrix type liquid crystal displays. Accordingly, a cathode ray tube (CRT) is being rapidly replaced by the active matrix type liquid crystal display.

In the active matrix type liquid crystal display, a data voltage is applied to pixel electrodes, and a common voltage is applied to common electrodes opposite the pixel electrodes. The common electrodes are commonly connected to panel common lines. Liquid crystal cells are driven by the voltages applied to the pixel electrodes and the common electrodes.

However, the common voltage is easily distorted by a deviation between resistances of the panel common lines or a deviation between the common voltages over the entire surface of a liquid crystal display panel based on a structure of the panel common lines. As shown in FIG. 1, because a common voltage Vcom is applied to a liquid crystal display panel through only two input positions of an upper portion of the liquid crystal display panel, it is difficult to hold the common voltage Vcom at a constant level over the entire surface of the liquid crystal display panel because of a load of panel common lines. Because the load of the panel common lines depends on an amount of RC delay defined by a multiplication of a resistance and a parasitic capacitance of the panel common lines, the load of the panel common lines increases as a distance between the panel common line and the input position increases. The deviation of the common voltage Vcom causes a difference between luminances of upper and lower portions of the liquid crystal display panel and a flicker, and also accumulates DC components inside the panel to thereby generate image sticking. Accordingly, line widths of the panel common lines have to increase so as to reduce the amount of RC delay. However, because an increase in the line widths of the panel common lines causes a reduction in an aperture ratio of the liquid crystal display panel, it is difficult to consider the increase in the line widths of the panel common lines.

The liquid crystal display has recently adopted a high speed driving method so as to prevent motion blur. In the high speed driving method, the common voltage Vcom is not kept constant and is affected by a scan pulse or a data voltage. Hence, a ripple phenomenon is generated in the common voltage Vcom. The ripple phenomenon of the common voltage Vcom generates a horizontal crosstalk when a specific data pattern is displayed on the screen.

SUMMARY OF THE INVENTION

Embodiments of the invention provide a liquid crystal display capable of reducing a distortion of a common voltage by increasing the number of input positions of the common voltage.

In one aspect, there is a liquid crystal display comprising a liquid crystal display panel on which a plurality of gate lines and a plurality of data lines cross one another and a plurality of liquid crystal cells are respectively arranged at crossings of the plurality of gate lines and the plurality of data lines in a matrix form, a panel common line connected to common electrodes of the liquid crystal cells, a power supply circuit configured to generate a common voltage to be applied to the common electrodes, a plurality of data circuit groups each including a data driver integrated circuit (IC) for driving the data lines, and a plurality of gate circuit groups each including a gate driver IC for driving the gate lines, the plurality of gate circuit groups being connected to one of the plurality of data circuit groups through a first line-on-glass (LOG) type signal line group, wherein the common voltage is supplied to the panel common line through a predetermined data circuit group of the plurality of data circuit groups and is supplied to the panel common line through the plurality of gate circuit groups.

The common voltage may be stabilized inside the gate driver IC of each of the plurality of gate circuit groups and then is supplied to the panel common line.

Each of first and last data circuit groups indicating the predetermined data circuit group may include a first dummy line group for transferring the common voltage. Each of the plurality of gate circuit groups may include a second dummy line group for transferring the common voltage.

The first LOG type signal line group may connect the adjacent gate circuit groups to each other.

A portion of each second dummy line group may be connected to the first LOG type signal line group, and a remaining portion of each second dummy line group may be connected to a second LOG type signal line group to connected to the panel common line.

The gate driver IC of each of the gate circuit groups may stabilize the common voltage input from the second dummy line group and may include one or two buffers used to supply the stabilized common voltage to the second LOG type signal line group.

The power supply circuit may be mounted on a source printed circuit board (PCB) connected to the data circuit groups. The common voltage may be supplied to the first dummy line groups through a common voltage supply line formed on the source PCB.

At least one buffer for minimizing a signal attenuation of the common voltage may be connected to the common voltage supply line.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
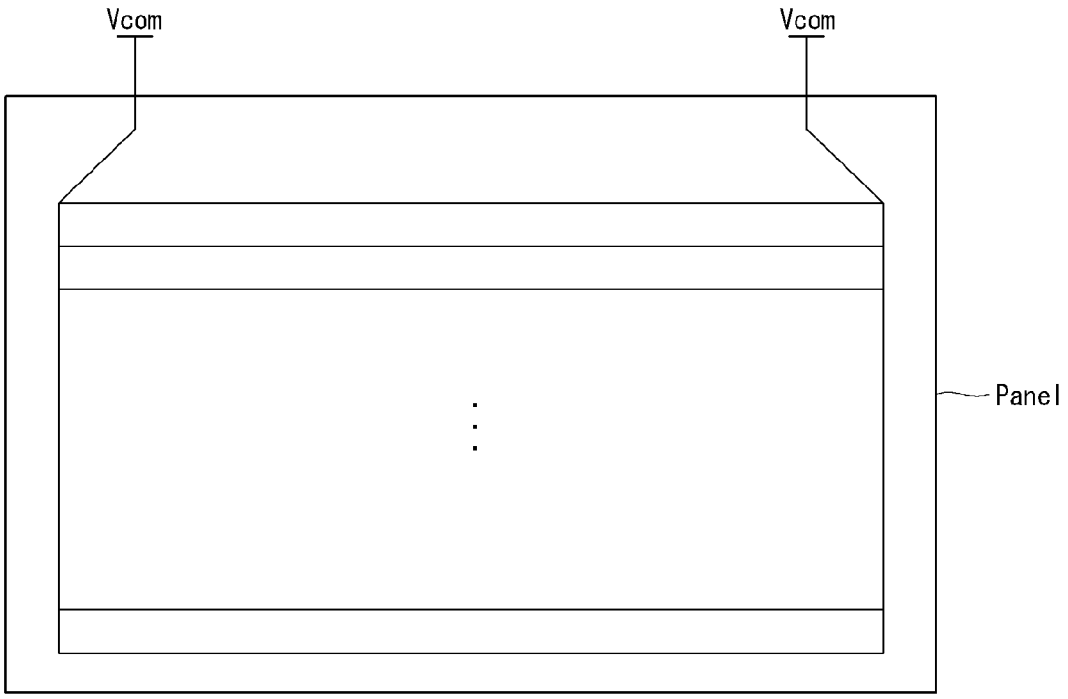
FIG. 1 (RELATED ART)
FIG. 1 illustrates a connection structure of related art panel common lines.
Figure 2:
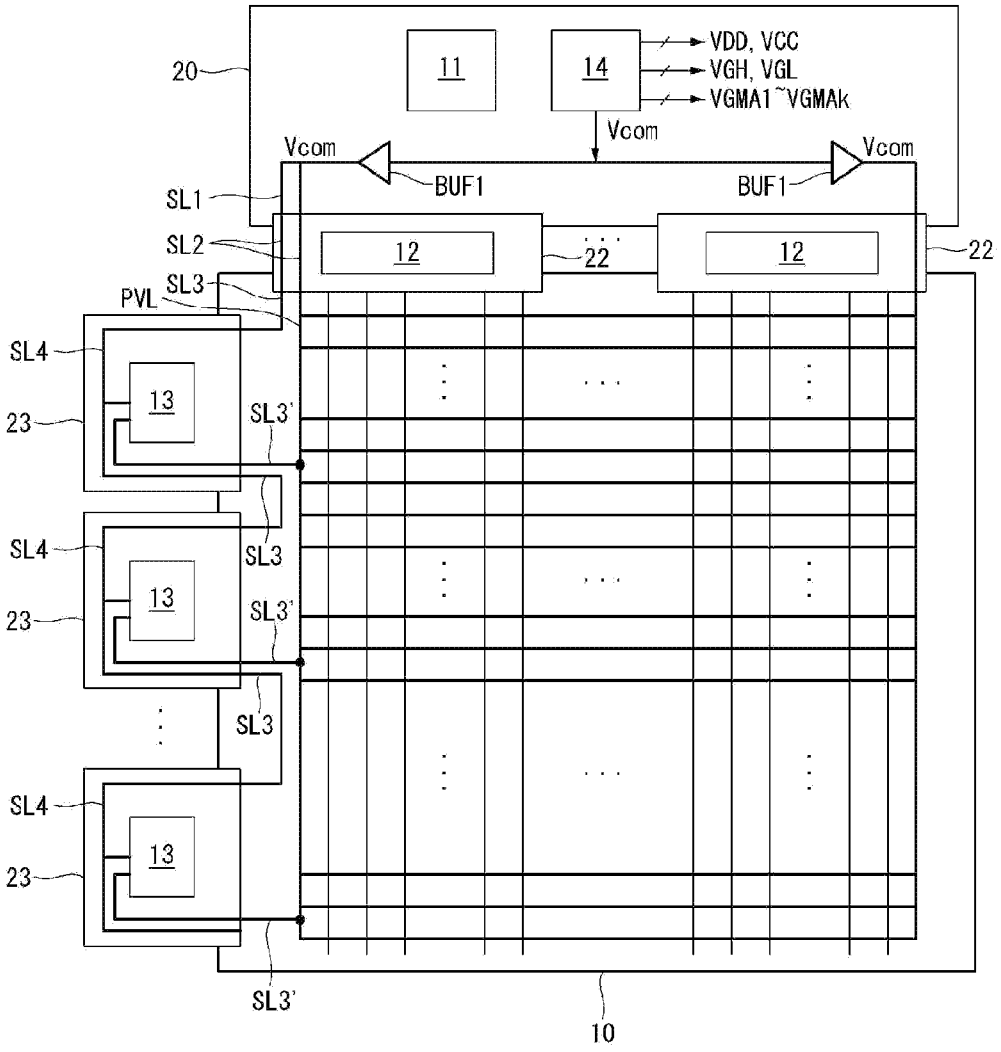
FIG. 2 illustrates a liquid crystal display according to an exemplary embodiment of the invention.

FIG. 2 illustrates a liquid crystal display according to an exemplary embodiment of the invention. As shown in FIG. 2, a liquid crystal display according to an exemplary embodiment of the invention includes a liquid crystal display panel 10, a timing controller 11, a data driving circuit, a gate driving circuit, and a power supply circuit 14.

Figure 3:
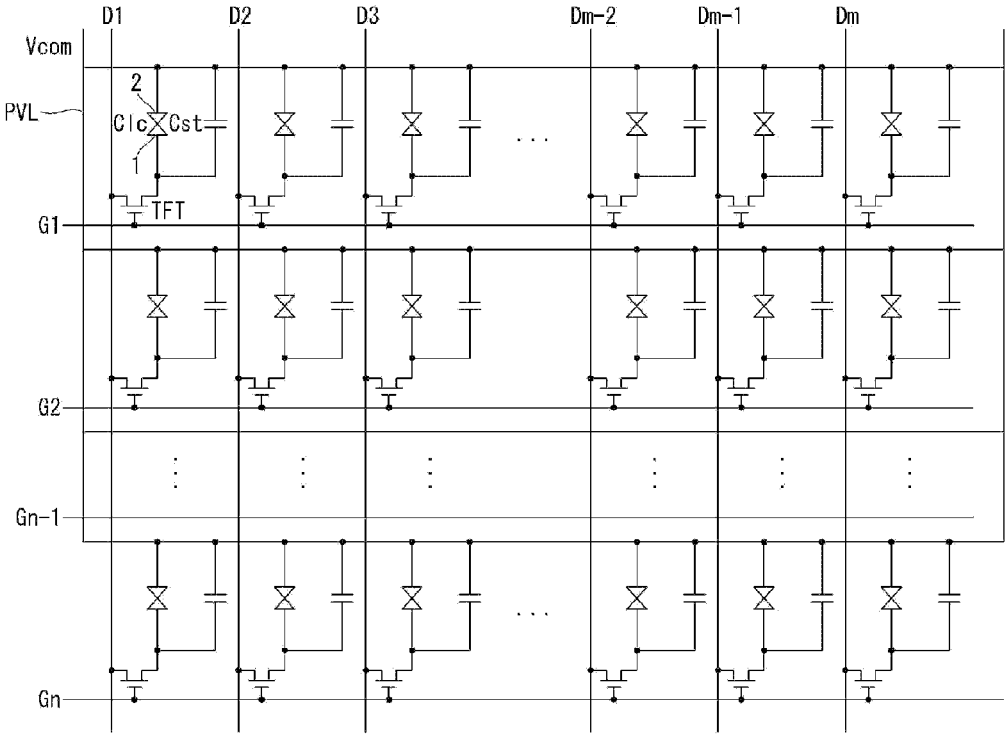
FIG. 3 illustrates a connection structure between liquid crystal cells and a panel common line.

The liquid crystal display panel 10 includes an upper glass substrate, a lower glass substrate, and a liquid crystal layer between the upper and lower glass substrates. As shown in FIG. 3, the liquid crystal display panel 10 includes m×n liquid crystal cells Clc arranged in a matrix form based on a crossing structure of a plurality of data lines D1 to Dm and a plurality of gate lines G1 to Gn.

The data lines D1 to Dm, the gate lines G1 to Gn, thin film transistors (TFTs), pixel electrodes 1 connected to the TFTs, common electrodes 2 that are positioned opposite the pixel electrodes 1 and form an electric field along with the pixel electrodes 1, a panel common line PVL connected to the common electrodes 2, storage capacitors Cst, and the like are formed on the lower glass substrate of the liquid crystal display panel 10. In a vertical electric field drive manner such as a twisted nematic (TN) mode and a vertical alignment (VA) mode, the common electrodes 2 are formed on the upper glass substrate. In a horizontal electric field drive manner such as an in-plane switching (IPS) mode and a fringe field switching (FFS) mode, the common electrodes 2 are formed on the lower glass substrate along with the pixel electrodes 1. The panel common line PVL includes edge common lines (not shown) formed at both edges (i.e., a non-display area) of the lower glass substrate in a direction parallel to the data lines D1 to Dm and transverse common lines (not shown) that are formed in a display area inside the non-display area in a direction parallel to the gate lines G1 to Gn and are connected to the edge common lines. The panel common line PVL supplies a common voltage Vcom input at two upper positions on the lower glass substrate of the liquid crystal display panel 10 to the common electrodes 2 and also supplies the common voltage Vcom received from each of gate driver integrated circuits (ICs) 13 to the common electrodes 2. Data pads (not shown) extending from the data lines D1 to Dm, gate pads (not shown) extending from the gate lines G1 to Gn, and first and second line-on-glass (LOG) type signal line groups SL3 and SL3' are formed in the non-display area of the lower glass substrate.

A black matrix, a color filter, and the like are formed on the upper glass substrate of the liquid crystal display panel 10. Polarizing plates crossing an optical axis at a right angle are attached respectively to the upper and lower glass substrates of the liquid crystal display panel 10. Alignment layers for setting a pre-tilt angle of the liquid crystals in an interface contacting the liquid crystals are respectively formed on the upper and lower glass substrates.

The timing controller 11 receives timing signals, such as horizontal and vertical sync signals, a data enable signal, and a dot clock, to generate a gate control signal for controlling operation timing of the gate driving circuit and a data control signal for controlling operation timing of the data driving circuit. The gate control signal includes a gate start pulse GSP, a gate shift clock GSC, a gate output enable signal GOE, and the like. The gate start pulse GSP indicates a start horizontal line of a scan operation during one vertical period in which one screen is displayed. The gate shift clock GSC is input to a shift resistor inside the gate driving circuit, sequentially shifts the gate start pulse GSP, and has a pulse width corresponding to an ON-period of the TFT. The gate output enable signal GOE indicates an output of the gate driving circuit. The data control signal includes a source sampling clock SSC, a source output enable signal SOE, a polarity control signal POL, and the like. The source sampling clock SSC indicates a latch operation of data inside the data driving circuit based on its rising or falling edge. The source output enable signal SOE indicates an output of the data driving circuit. The polarity control signal POL indicates a polarity of a data voltage to be supplied to the liquid crystal cells Clc of the liquid crystal display panel 10.

The timing controller 11 arranges digital video data received from the outside in conformity with a resolution of the liquid crystal display panel 10 and then supplies the arranged digital video data to the data driving circuit. The timing controller 11 modulates the data based on a mini low voltage differential signaling (LVDS) manner or a reduced swing differential signaling (RSDS) manner and then supplies the modulated data to the data driving circuit, so as to reduce electromagnetic interference (EMI) and a swing width of the data voltage in a transfer path of data. The timing controller 11 may be mounted on a source printed circuit board (PCB) 20.

The data driving circuit includes a plurality of data driver ICs 12. Each of the data driver ICs 12 latches the digital video data under the control of the timing controller 11 and then converts the latched digital video data into positive and negative analog data voltages. Each data driver IC 12 then supplies the positive/negative analog data voltage to the data lines D1 to Dm. The data driver ICs 12 are respectively mounted on source chip-on-films (COFs) 22. A source tape carrier package (TCP) may replace the source COF 22. The source COF 22/source TCP and the data driver IC 12 mounted on the source COF 22/source TCP may be called a data circuit group. The source COFs 22 electrically connect the source PCB 20 to the liquid crystal display panel 10. Input terminals of the source COFs 22 are electrically connected to output terminals of the source PCB 20, and output terminals of the source COFs 22 are electrically connected to the data pads formed on the lower glass substrate of the liquid crystal display panel 10 through an anisotropic conductive film (ACF). First dummy line groups SL2 are respectively formed on the source COFs 22 to electrically connect a common voltage supply line SL1 of the source PCB 20 to the first LOG type signal line groups SL3 and the panel common line PVL of the lower glass substrate. The first dummy line group SL2 supplies the common voltage Vcom on the common voltage supply line SL1 to the first LOG type signal line group SL3 and the panel common line PVL. The first dummy line group SL2 may supply gate driving signals received from the timing controller 11 and the power supply circuit 14 to the first LOG type signal line group SL3 through signal lines (not shown) formed on the source PCB 20. The gate driving signals include the gate control signal GDC including the gate start pulse GSP, the gate shift clock GSC, the gate output enable signal GOE, etc., a gate high voltage VGH, and a gate low voltage VGL.

The gate driving circuit includes a plurality of gate driver ICs 13. Each of the gate driver ICs 13 includes a shift register, a level shifter for converting an output signal of the shift register into a swing width suitable for a TFT drive of the liquid crystal cells, an output buffer, and the like. Each gate driver IC 13 is sequentially outputs a scan pulse (or a gate pulse) to the gate lines G1 to Gn under the control of the timing controller 11. The gate driver ICs 13 are respectively mounted on gate COFs 23 or a gate TCPs and are electrically connected to the gate pads formed on the lower glass substrate of the liquid crystal display panel 10 through an anisotropic conductive film (ACF). The gate COF 23/gate TCP and the gate driver IC 13 mounted on the gate COF 23/gate TCP may be called a gate circuit group. Second dummy line groups SL4 are respectively formed on the gate COFs 23 to electrically connect the gate driver ICs 13 to the first and second LOG type signal line groups SL3 and SL3'. The second dummy line group SL4 supplies the common voltage Vcom and the gate driving signals GDC, VGH, and VGL received from the first LOG type signal line group SL3 to the gate driver IC 13 and supplies the common voltage Vcom stabilized by the gate driver IC 13 to the second LOG type signal line group SL3'. The common voltage Vcom is supplied to the edge common lines through the second LOG type signal line groups SL3'.

The power supply circuit 14 adjusts a voltage received from the outside to generate voltages required to drive the liquid crystal display panel 10. The voltages generated by the power supply circuit 14 include a high potential power voltage VDD equal to or less than 8V, a logic power voltage VCC of about 3.3V, a gate high voltage VGH equal to or greater than 15V, a gate low voltage VGL equal to or less than −3V, the common voltage Vcom between 7V and 8V, positive/negative gamma reference voltages VGMA1 to VGMAk, and the like. The power supply circuit 14 may be mounted on the source PCB 20. The common voltage supply line SL1 and a plurality of signal lines (not shown) are formed on the source PCB 20. The common voltage supply line SL1 is connected to dummy lines formed on a first source COF 22 and a last source COF 22 and supplies the common voltage Vcom generated by the power supply circuit 14 to the edge common lines formed at both edges of the lower glass substrate. Further, the common voltage supply line SL1 is connected to the first dummy line group SL2 formed on the first source COF 22 and supplies the common voltage Vcom generated by the power supply circuit 14 to the first LOG type signal line groups SL3. The common voltage supply line SL1 may be connected to at least one first buffer BUF1 on the source PCB 20 so as to reduce a signal attenuation in a transfer of the common voltage Vcom. The plurality of signal lines (not shown) on the source PCB 20 are connected to the first dummy line group SL2 on the first source COF 22 and supply the gate driving signals GDC, VGH, and VGL received from the timing controller 11 and the power supply circuit 14 to the first LOG type signal line groups SL3.

Figure 4:
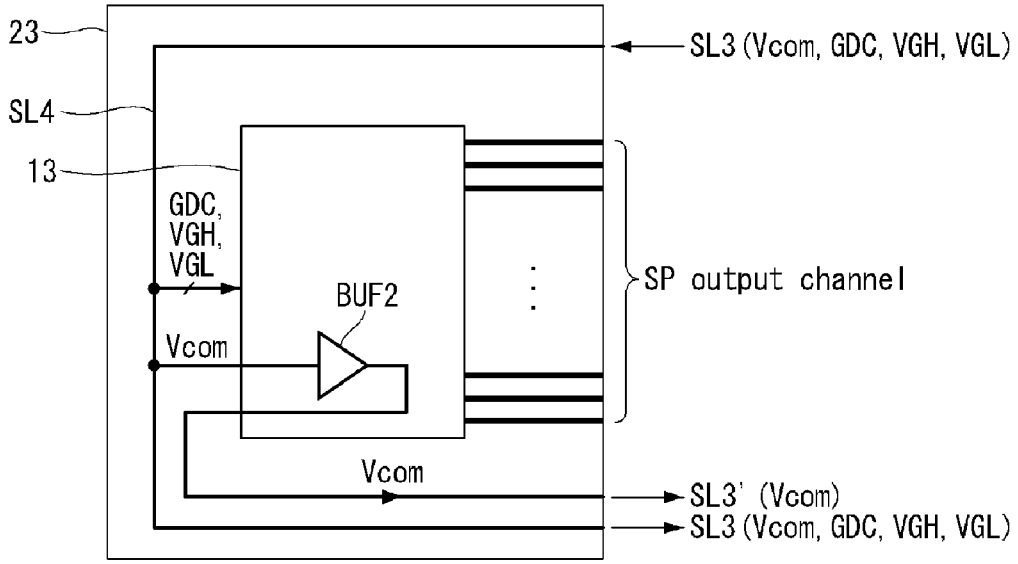
FIG. 4 illustrates an example of a gate driver integrated circuit (IC)

FIG. 4 illustrates an example of the gate driver IC 13.

As shown in FIG. 4, the gate driver IC 13 is mounted on the gate COF 23 and is connected to the first and second LOG type signal line groups SL3 and SL3' through the second dummy line group SL4 formed on the gate COF 23.

The gate driver IC 13 generates a scan pulse SP using the gate driving signals GDC, VGH, and VGL supplied through the first LOG type signal line group SL3 and the second dummy line group SL4 and outputs the scan pulse SP to output channels connected to the gate pads. The scan pulse SP is sequentially supplied to the gate lines G1 to Gn respectively connected to the output channels.

The gate driver IC 13 stabilizes the common voltage Vcom supplied through the first LOG type signal line group SL3 and the second dummy line group SL4 and then supplies the stabilized common voltage Vcom to the edge common lines through the second LOG type signal line group SL3'. The gate driver IC 13 includes a second buffer BUF2 so as to stabilize the common voltage Vcom. The second buffer BUF2 minimizes a deviation of the common voltage Vcom at each position of the liquid crystal display panel 10 determined depending on an amount of RC delay and a ripple applied to the common voltage Vcom in a high-speed drive, thereby stabilizing the common voltage Vcom at a constant DC level.

As shown in FIG. 4, the common voltage Vcom is supplied to the liquid crystal display panel 10 at many input positions equal to or more than the number of related art gate driver ICs and is stabilized at a constant level inside the gate driver IC 13. The gate driver IC 13 then supplies the stabilized common voltage Vcom to the edge common lines. Accordingly, the distortion of the common voltage Vcom is greatly reduced as compared with the related art liquid crystal display.

Figure 5:
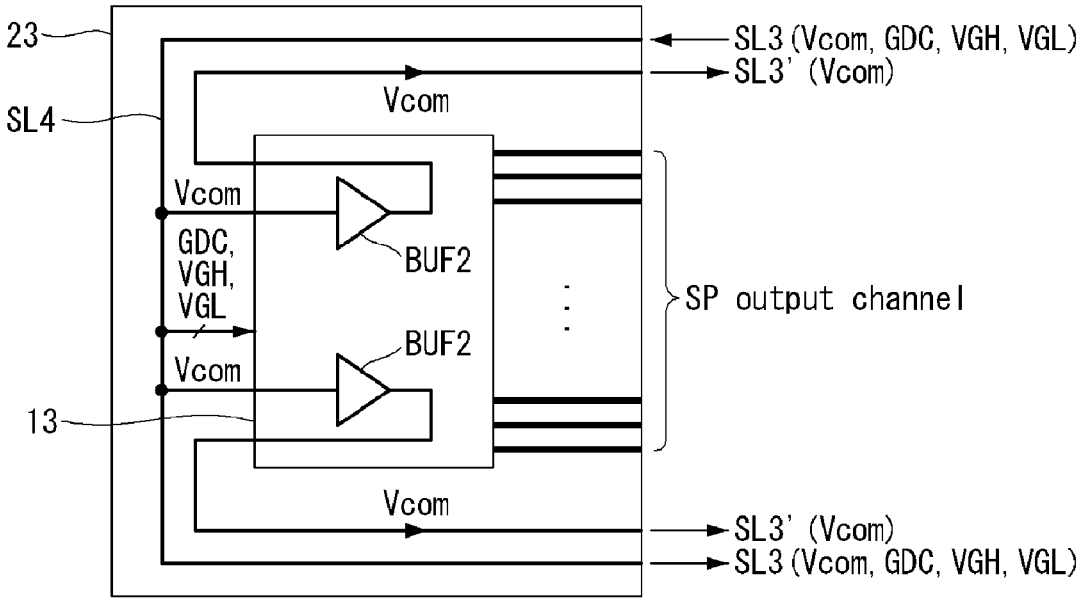
FIG. 5 illustrates another example of a gate driver integrated circuit (IC).

FIG. 5 illustrates another example of the gate driver IC 13.

As shown in FIG. 5, the gate driver IC 13 is mounted on the gate COF 23 and is connected to the first and second LOG type signal line groups SL3 and SL3' through the second dummy line group SL4 on the gate COF 23.

The gate driver IC 13 generates a scan pulse SP using the gate driving signals GDC, VGH, and VGL supplied through the first LOG type signal line group SL3 and the second dummy line group SL4 and outputs the scan pulse SP to output channels connected to the gate pads. The scan pulse SP is sequentially supplied to the gate lines G1 to Gn respectively connected to the output channels.

The gate driver IC 13 stabilizes the common voltage Vcom supplied through the first LOG type signal line group SL3 and the second dummy line group SL4 and then supplies the stabilized common voltage Vcom to the edge common lines through the two second LOG type signal line groups SL3'. The gate driver IC 13 includes a pair of second buffers BUF2 so as to stabilize the common voltage Vcom. The pair of second buffers BUF2 minimize a deviation of the common voltage Vcom at each position of the liquid crystal display panel 10 determined depending on an amount of RC delay and a ripple applied to the common voltage Vcom in a high-speed drive, thereby stabilizing the common voltage Vcom at a constant DC level.

As shown in FIG. 5, the common voltage Vcom is supplied to the liquid crystal display panel 10 at many input positions corresponding to two times the number of related art gate driver ICs and is stabilized at a constant level inside the gate driver IC 13. The gate driver IC 13 then supplies the stabilized common voltage Vcom to the edge common lines. Accordingly, the distortion of the common voltage Vcom is greatly reduced as compared with the related art liquid crystal display.

As described above, the liquid crystal display according to the exemplary embodiment of the invention stabilizes the common voltage inside each gate driver IC and then supplies the stabilized common voltage to the panel common line. Accordingly, the distortion of the common voltage can be greatly reduced because of an increase in the input positions of the common voltage.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display, comprising:

a liquid crystal display panel on which a plurality of gate lines and a plurality of data lines cross one another and a plurality of liquid crystal cells are respectively arranged at crossings of the plurality of gate lines and the plurality of data lines in a matrix form;

a panel common line including edge common lines and transverse common lines, wherein the edge common lines are formed at both edges corresponding to a non-display area of the liquid crystal display panel parallel with the data lines, and wherein the transverse common lines are formed in a display area of the liquid crystal display panel parallel with the gate lines and are connected to the edge common lines and common electrodes of the liquid crystal cells;

a power supply circuit configured to generate a common voltage to be applied to the common electrodes;

a plurality of data circuit groups each including a data driver integrated circuit (IC) for driving the data lines; and a plurality of gate circuit groups each including a gate driver IC for driving the gate lines, the plurality of gate circuit groups being connected to one of the plurality of data circuit groups through a first line-on-glass (LOG) type signal line group, wherein each of first and last data circuit groups includes a first dummy line group for transferring the common voltage, and each of the plurality of gate circuit groups includes a second dummy line group for transferring the common voltage, and wherein a portion of each second dummy line group is connected to the first LOG type signal line group, and wherein a remaining portion of each second dummy line group is connected to one of the edge common lines via a second LOG type signal line group.

2. The liquid crystal display of claim 1, wherein the common voltage is stabilized inside the gate driver IC of each of the plurality of gate circuit groups and then is supplied to the panel common line.

3. The liquid crystal display of claim 1, wherein the first LOG type signal line group connects the adjacent gate circuit groups to each other.

4. The liquid crystal display of claim 1, wherein the gate driver IC of each of the gate circuit groups stabilizes the common voltage input from the second dummy line group and includes a buffer used to supply the stabilized common voltage to the second LOG type signal line group.

5. The liquid crystal display of claim 1, wherein:

the power supply circuit is mounted on a source printed circuit board (PCB) connected to the data circuit groups; and the common voltage is supplied to the first dummy line groups through a common voltage supply line formed on the source PCB.

6. The liquid crystal display of claim 5, wherein at least one buffer for minimizing a signal attenuation of the common voltage is connected to the common voltage supply line.

* * * * *